US006029276A

United States Patent [19]

White

[11] Patent Number: 6,029,276

[45] Date of Patent: Feb. 29, 2000

[54] COLD WEATHER OUTDOOR GLOVE

[76] Inventor: Patrick J. White, 19 Oxford Rd., Newport News, Va. 23606

[21] Appl. No.: 09/157,929

[22] Filed: Sep. 21, 1998

Related U.S. Application Data

[60] Provisional application No. 60/060,129, Sep. 26, 1997.

[51] Int. Cl.[7] ..... A41D 19/00

[52] U.S. Cl. ..... 2/161.6; 2/161.7; 2/163; 2/161.1

[58] Field of Search ..... 2/159, 160, 161.1, 2/161.3, 161.6, 161.7, 161.8, 163, 168

[56] References Cited

U.S. PATENT DOCUMENTS

| | | | |
|---|---|---|---|
| 133,319 | 11/1872 | Kehoe . | |
| 474,929 | 5/1892 | Tabor et al. . | |
| 1,358,823 | 11/1920 | Burden . | |
| 2,736,034 | 2/1956 | Fredenhagen et al. . | |
| 3,096,523 | 7/1963 | Bruchas . | |
| 3,416,158 | 12/1968 | Kulman | 2/161.6 |
| 4,149,601 | 4/1979 | Taylor | 2/161 |
| 4,441,213 | 4/1984 | Trumble et al. | 2/161 |
| 4,507,807 | 4/1985 | Karkanen . | |
| 4,774,727 | 10/1988 | Jackson . | |
| 5,487,188 | 1/1996 | Micheloni . | |
| 5,548,844 | 8/1996 | Ceresia | 2/161.7 |

FOREIGN PATENT DOCUMENTS

| | | | |
|---|---|---|---|
| 0196637 | 10/1986 | European Pat. Off. . | |
| 196637 | 8/1986 | Japan | 2/161 |
| 2089197 | 6/1982 | United Kingdom | 2/159 |
| 2261808 | 2/1993 | United Kingdom | 2/159 |
| 2284341 | 7/1995 | United Kingdom . | |

*Primary Examiner*—Diana Oleksa
*Assistant Examiner*—Kate Moran
*Attorney, Agent, or Firm*—Richard C. Litman

[57] ABSTRACT

A glove having a relatively thick, warm, protective, loose fitting body portion and fingers made up of 1) a relatively thick, warm, protective, loose fitting base portion continuous with the body portion, and 2) a relatively thin, tactile, tight, form-fitting tip portion stitched to the base portion.

10 Claims, 3 Drawing Sheets

COLD WEATHER OUTDOOR GLOVE

CROSS-REFERENCE TO RELATED APPLICATION

This application claims the benefit of U.S. Provisional Patent Application Ser. No. 60/060,129, filed Sep. 26, 1997.

BACKGROUND OF THE INVENTION

1. Field of The Invention

The present invention relates generally to gloves and, more specifically, to gloves designed to protect the human hand from damaging effects of severely cold air, while enabling the wearer to perform detailed precision tasks requiring high tactility in the distal portion of the fingers.

2. Description of Related Art

The need to modify gloves in order to accomplish a specialized work or recreational purpose is known. For example, U.S. Pat. No. 3,096,523, issued to George R. Bruchas on Jul. 9, 1963, describes a glove with patches of improved gripping material on the fingertips for grasping a football. Similarly, U.S. Pat. No. 2,736,034, issued to Eva Redick Fredenhagen et al. on Feb. 28, 1956, describes a glove with weights added to the fingertips for exercising and improving the finger strength of typists and piano players. Likewise, U.S. Pat. No. 4,774,727, issued to Grant W. Jackson on Oct. 4, 1988, describes an apple picking glove with foam rubber padded fingertips to prevent the bruising of fruit picked by the wearer of the glove. Another patent showing a modified glove is European Patent Number 196,637, published on Oct. 8, 1986, which shows a work glove modified to shield the fingertips from the crushing effects of heavy machinery.

The need to modify gloves in an effort to reconcile the competing needs of work related requirements and ambient temperature conditions has long been known. For example, U.S. Pat. No. 133,319, issued to Timothy Kehoe on Nov. 26, 1872, describes a heavily vented work glove with padded fingertips to protect, yet cool, the hands of bricklayers working in hot weather. Thus, there is a need for a modified glove to reconcile the competing needs of work related requirements and ambient temperature conditions.

The need to protect the human hand with a glove under certain ambient conditions such as cold air has long been well known. U.S. Pat. No. 1,358,823, issued to Everett Burden on Nov. 16, 1920, addresses this problem by providing for a horse riding glove having reversible reinforced fingertips. Thus, there is a need for a glove capable of protecting a human hand from the potentially harmful effects of extended exposure to cold air during work or recreational activity.

However, the ability to perform necessary work or recreational tasks outdoors with the hands is often impeded by a glove worn to protect a hand from cold temperatures. Warm, but bulky fingertips in gloves tend to impede the performance of work tasks demanding high tactility for a detailed precision task. For example, it is difficult for outdoor goods and services providers to make change for their cash paying customers when the goods or services provider is wearing protective gloves due to cold weather. This problem is described in U.S. Pat. No. 474,929, issued to Levi L. Tabor et al. on May 17, 1892, for a mitten with a removable thumb and forefinger. This problem is also approached in British Patent Number 2,284,341, published on Jun. 7, 1995, which describes a glove having small circular elastic openings in the fingertips whereby the fingertip of the glove can be pulled back over the finger, thus exposing the finger for precision work. The gloves taught in both of these patents require the distal portion of the bare finger to be exposed to the elements when precision work is being performed.

A simpler approach with the same resulting problem involves manually exposing the fingertips of a human hand for improved tactility by cutting off and disposing of the fingertips in an otherwise standard pair of work gloves. In addition to destroying the glove structure, this simpler approach also leaves human fingertips vulnerable to frostbite through exposure to extremely cold temperatures. Thus, there is a need for an outdoor work glove with improved tactile fingertips that does not require exposure of the bare fingertips.

The same need exists for many recreational applications. Both sailing and weightlifting gloves known in the marketplace have the fingertips cut off and removed by design, thus exposing the distal portion of the wearers fingers for an improved sense of touch. Sailing and weightlifting gloves are designed to protect the wearer from the harmful effects of severe friction, primarily on the wearer's palms; however, sailing, competitive sailing in particular, sometimes takes place under cold, wet conditions where the effects of temperature exposure are also potentially harmful to the human hand.

A century ago this need may have been felt most often vocationally by a trolley car conductor. Today, this need may be felt most often vocationally by a telephone or heat pump service worker or any other person who must work outside in the cold with nuts, bolts, rolls of tape, sheets of metal, small wires such as electrical wires, screws, nails, or anything else requiring a sensitive, detailed, or precise level of touch. The need for a glove with improved tactility in the fingertips is described in U.S. Pat. No. 4,507,807, issued to Kip M. Karkanen on Apr. 2, 1985 for a work glove having fingertips of a stretchable material for improved sensitivity. Thus, there is a need for a glove enabling the wearer of the glove to perform tasks that require high tactile abilities.

This need also exists in the context of many recreational activities. For example, in addition to the sailors previously mentioned, marching band members who handle metal instruments also have a need for a glove which protects the human hand from the harmful effects of cold weather, yet enable the wearer's fingers to perform detailed precision tasks.

None of the above inventions and patents, taken either singly or in combination, is seen to describe the instant invention as claimed.

SUMMARY OF THE INVENTION

The present invention is a glove designed for recreational and work related tasks that require a precise and detailed sense of touch, yet must be performed in severely cold air or weather. The glove has a relatively thick, warm, protective, loose fitting body portion, and fingers consisting of 1) a relatively thick, warm, protective, loose fitting base portion continuous with the body portion, and 2) a relatively thin, tactile, tight, form-fitting tip portion stitched to the base portion. The glove protects the wearer's hand and fingers from harm due to cold or friction, yet enables the wearer to have a heightened tactile ability to perform detailed precision tasks.

Accordingly, it is a principal object of the invention to protect human hands from the physically damaging effects of severely cold air, yet enable a human wearer to perform detailed precision work or recreational tasks with a high level of tactility while keeping the distal portion of the bare human finger protected from exposure to ambient temperature and weather conditions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
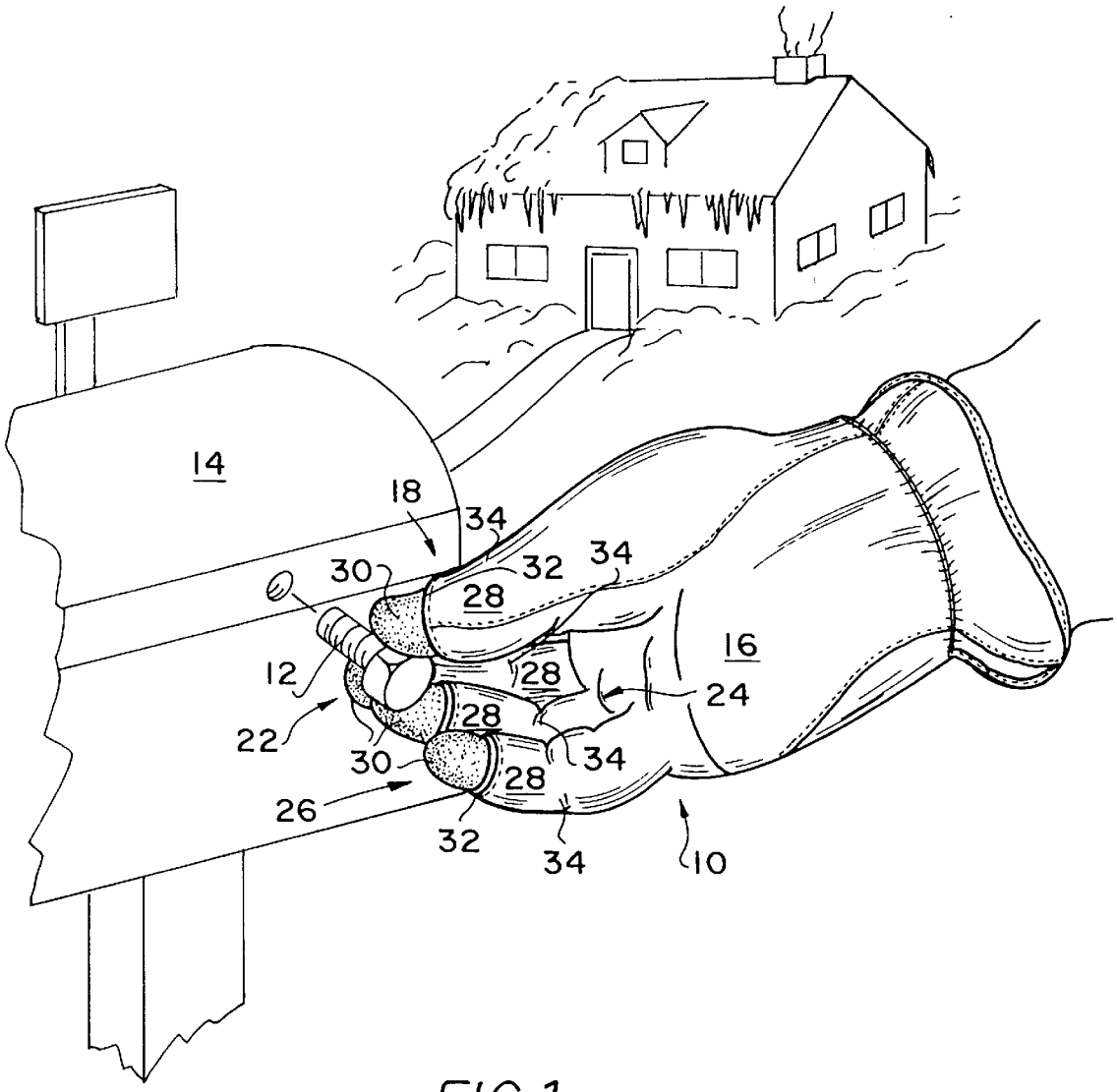
FIG. 1 is an environmental perspective view of an embodiment of a cold weather outdoor glove according to the present invention.

The present invention is a glove designed for recreational and work related tasks that require a precise and detailed sense of touch, yet must be performed in severely cold air or weather. Referring to FIG. 1, a hand in a glove 10 is shown grasping a bolt 12 as necessary for an outdoor mailbox 14 repair on a severely cold winter day. The glove 10, shown somewhat more clearly in FIG. 2, has a body 16, a thumb 18, a pointer finger 20, a middle finger 22, a ring finger 24, and a pinky finger 26. The thumb 18 has a base portion 28 and a tip portion 30. Similarly, the pointer finger 20, the middle finger 22, the ring finger 24, and the pinky finger 26 have a base portion 28 and a tip portion 30.

The body 16 and the base portions 28 are fabricated from a continuous piece of material. The glove 10 is designed to protect the wearer's hand and fingers from harm due to cold or friction. Thus, the material from which the body 16 and the base portions 28 are fabricated is relatively thick, warm, and protective. Leather is preferred, however rawhide, burlap, cotton, polyester, and other fabric blends are also believed to be acceptable. In order to provide adequate warmth and protection, the material from which the body 16 and the base portions 28 are fabricated is preferably at least one-sixteenth of an inch thick.

It is not necessary for the body 16 or the base portions 28 to be particularly tight fitting. Thus, for the purpose of simplified mass production and ease of fitting, it is recommended that the body 16 and the base portions 28 be relatively loose fitting. The degree of looseness typical in a common work glove known in the art is an acceptable level of looseness for the body 16 and base portions 28.

The tip portions 30 are designed to provide an improved sense of touch while keeping the distal portion of the glove 10 wearer's finger covered and protected from bare exposure to the elements. Thus, the glove 10 enables the wearer of the glove 10 to have a heightened tactile ability to perform detailed precision tasks while protecting the distal portion of the wearer's fingers from bare exposure to the elements.

In order to increase the tactility of the tip portions 30 over the level of tactility available from the relatively thick, warm, protective material of the base portions 28, the material from which the tip portions 30 are fabricated is relatively thin compared to the material from which the base portions 28 are fabricated. Thus, the thickness of the material in the tip portions 30 is preferably less than one-sixteenth of an inch. One suitable material for the tip portion 30 is spandex, a stretchable material having a resilient memory.

However, many tasks require a firm, even tacky, grip. The texture of spandex tends to have a sheen and be slightly slippery. Further, not all spandex wearers find it to be a comfortable material. Thus, latex rubber is preferred to spandex as the material of the tip portions 30. Jersey is also an acceptable material.

Similarly, a stretchable material is not comfortable to all wearers. Additionally, the gripping surface of a stretchable material may be compromised by the stretching of the material during gripping. Therefore, it is preferable that the tip portions 30 be fabricated from a non-stretchable material. Molded vinyl is preferred. Neoprene is also acceptable.

Nonetheless, the tip portions 30 are form-fitting in order to achieve the maximum tactility possible for the tip portions 30. That is, the tip portions 30 are relatively tight so as to have a superior sense of touch. The tip portions 30 are tight enough to be form-fitted to the fingertips of the hand of the person wearing the glove 10, but not so tight as to cause pain, discomfort, or physical harm to the wearer of the glove 10. Stated differently, the tip portions 30 are semi-tight.

Figure 3:
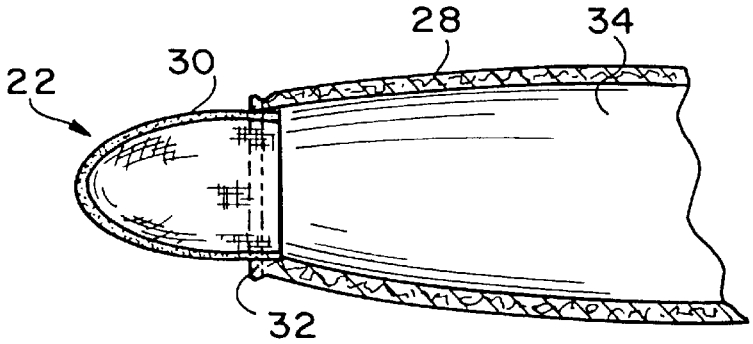
FIG. 3 is a sectional view of a finger of the cold weather outdoor glove shown in FIGS. 2 and 3 according to the present invention.

The tip portions 30 are permanently sewn to the base portions 28 by stitching 32. FIG. 3 further illustrates the stitching 32 which connects the tip portions 30 to the base portions 28 in a sectional view of the middle finger 22.

Figure 4:
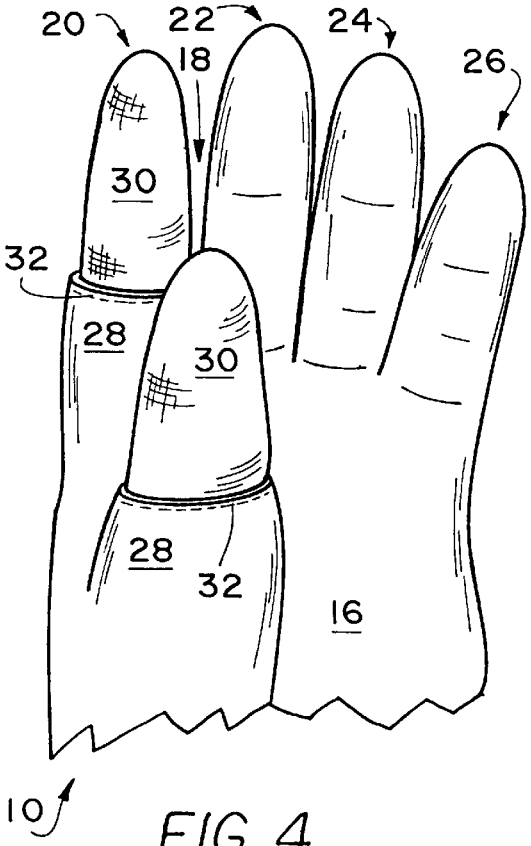
FIG. 4 is a plan view of an alternative embodiment of a cold weather outdoor glove according to the present invention.
Figure 5:
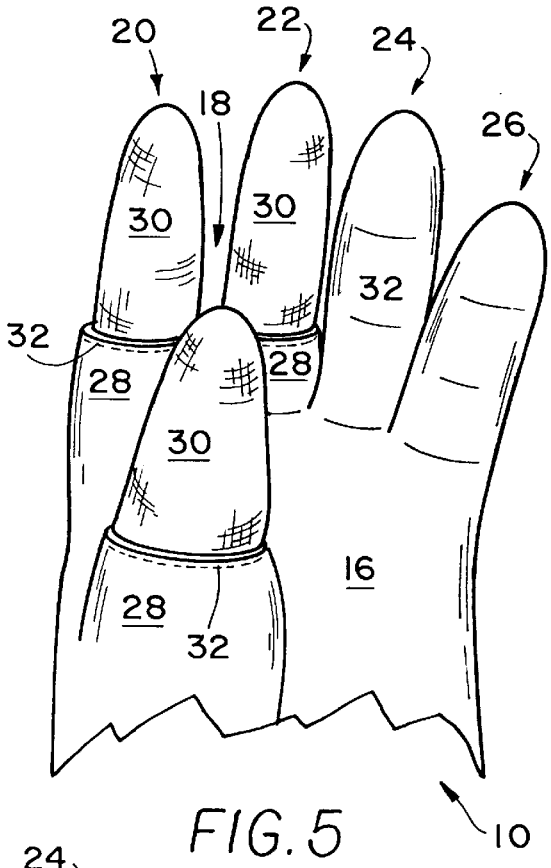
FIG. 5 is a plan view of yet another alternative embodiment of a cold weather outdoor glove according to the present invention.
Figure 6:
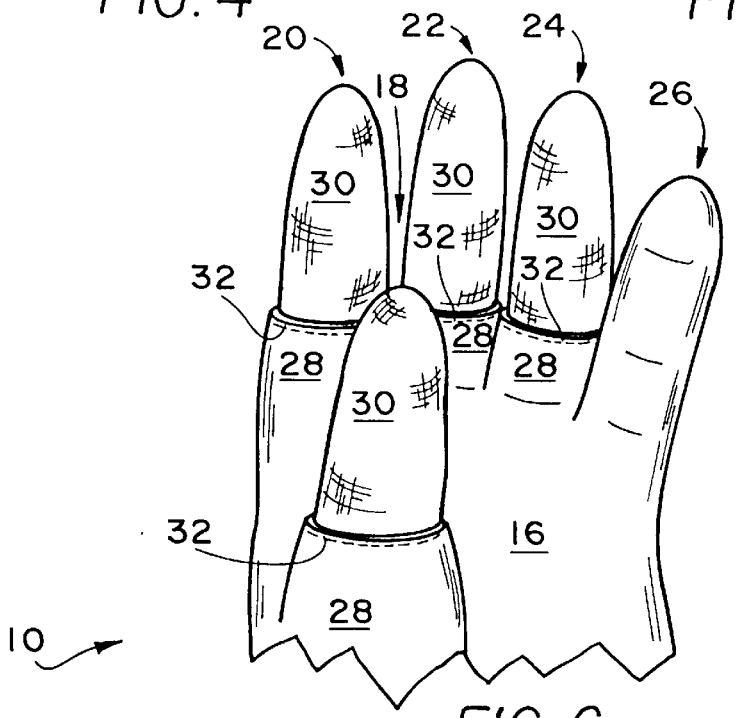
FIG. 6 is a plan view of still another alternative embodiment of a cold weather outdoor glove according to the present invention.

Some tasks only require highly tactile abilities at the furthest distal extremity of the glove 10 wearer's fingertips. Tasks limited to the grasping or holding of only very small objects are in this category. However, many work and recreational tasks require a highly detailed and precise level of touch sensation over a substantially larger portion of the glove 10 wearer's finger, particularly where the object being grasped or held is a larger object. Therefore, in an alternative embodiment of the present invention the tip portion 30 is larger, extending to the center joint 34 on wearer's fingers. Thus, in this embodiment, the tip portions 30 are at least one inch long. This longer embodiment of the tip portions 30 is shown in FIGS. 4 through 6.

It is believed that most work related tasks requiring a highly detailed and precise level of touch only require that high level of tactility in the tip portion 30 of the thumb 18, and in the tip portion 30 of the pointer finger 20, but not in the tip portion 30 of the middle finger 22, the ring finger 24, and the pinky finger 26. Thus, in an alternative embodiment of the present invention for work applications, the relatively thick, warm, protective fabric of the body 16 is continuous through the end of the middle finger 22, the ring finger 24, and the pinky finger 26, as shown in FIG. 4. In other words, the form fitting tip portion 30 of a thinner material is omitted from the middle finger 22, the ring finger 24, and the pinky finger 26 in an alternative embodiment of the glove 10 designed for work related tasks. This embodiment provides greater protection from the harmful effects of severely cold air and weather while still enabling the wearer of the glove 10 to perform most work related tasks requiring an ability to grasp small objects with a detailed and precise sense of touch.

The preferred embodiment of the present invention provides a good balance between the competing goals of protection from harm due to exposure and improved tactile abilities in the fingertips. This preferred embodiment modifies the embodiment of the work glove 10 shown in FIG. 4 to provide a tip portion 30 of the thinner tactile material on the middle finger 22, in addition to the thumb 18 and the pointer finger 20, while leaving the entire ring finger 24 and pinky finger 26 constructed continuously of the relatively thick, warm, protective material of the body 16, thus omitting the tip portion 30 of the thinner tactile material from the ring finger 24 and the pinky finger 26, as shown in FIG. 5.

Figure 2:
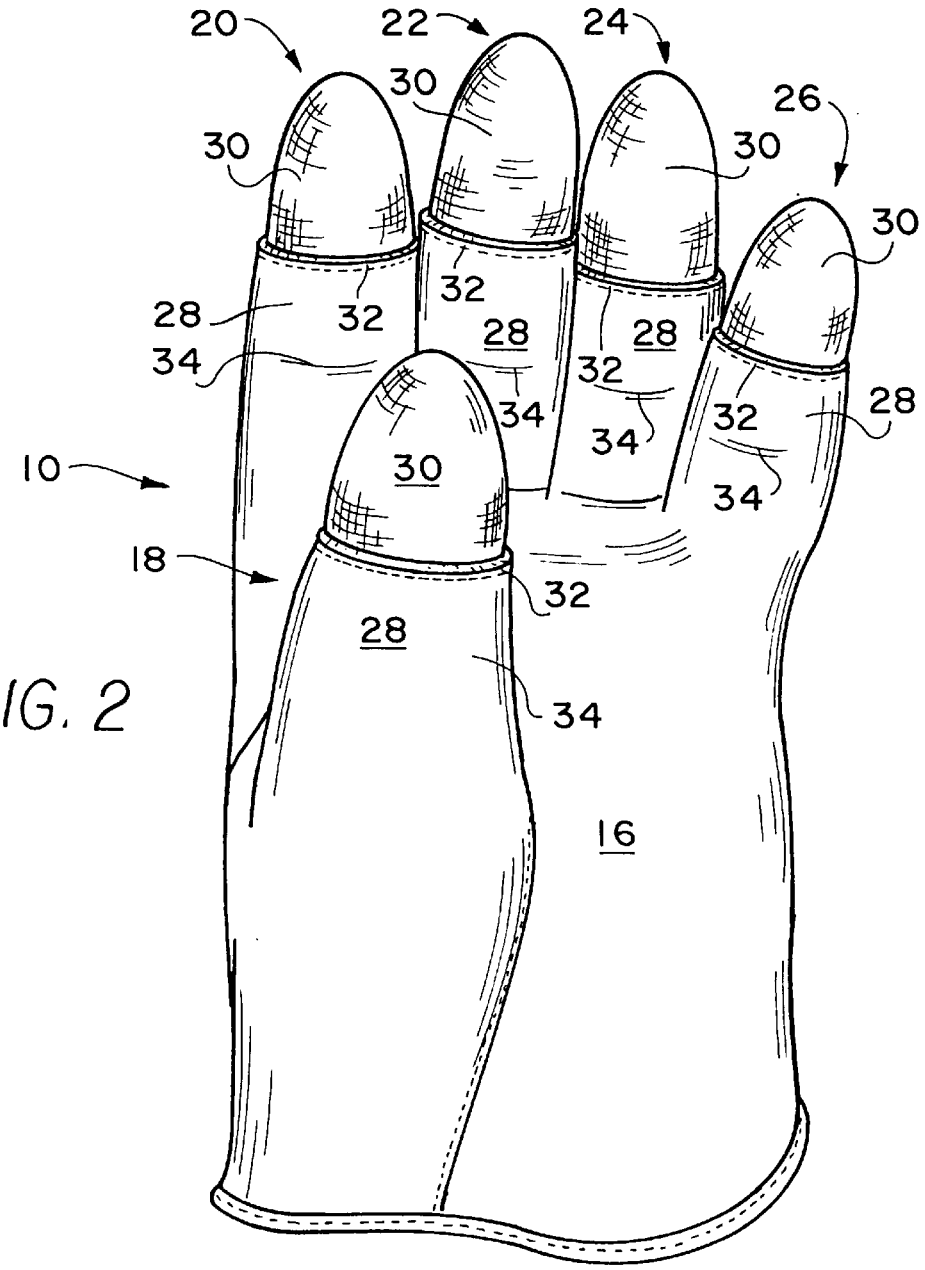
FIG. 2 is a plan view of the cold weather outdoor glove shown in FIG. 1 according to the present invention.

It is believed that improved tactility is rarely, if ever, required of the pinky finger 26 for a work related task. Thus, yet another embodiment, shown in FIG. 6, includes the thinner, more tactile, tip portion 30 in the thumb 18, pointer finger 20, middle finger 22, and ring finger 24, but constructs the pinky finger 26 of the relatively thick, warm, protective material of the body 16 continuous with the body 16. It should be apparent that many recreational applications of the present invention, such as playing an instrument in a marching band, require a tip portion 30 of the thinner, more tactile material on all five fingers 18–26 of the glove 10, as shown in FIGS. 1 through 3.

It is to be understood that the present invention is not limited to the embodiments described above, but encompasses any and all embodiments within the scope of the following claims.

I claim:

1. A glove comprising:

a relatively loose fitting body of a relatively thick, warm, protective fabric;

a thumb segment including a relatively loose fitting thumb base portion of the relatively thick, warm, protective fabric, the thumb base portion being continuous with the body, and a relatively tight, form-fitting thumb tip portion of a relatively thin, tactile material, the thumb tip portion being permanently attached to the thumb base portion;

an index finger portion including a relatively loose fitting index finger base portion of the relatively thick, warm, protective fabric, the index finger base portion being continuous with the body, and a relatively tight, form-fitting index fingertip portion of a relatively thin, tactile material, the index fingertip portion being permanently attached to the pointer base portion;

a middle finger segment;

a ring finger segment; and a pinky finger segment.

2. The glove according to claim 1, wherein the middle finger, the ring finger, and the pinky finger segments are fabricated entirely from the relatively thick, warm, protective fabric, and are continuous with the body.

3. The glove according to claim 1, wherein the middle finger segment includes a relatively loose fitting middle finger base portion of the relatively thick, warm, protective fabric, the middle finger base portion being continuous with the body, and a relatively tight, form-fitting middle fingertip portion of a relatively thin, tactile material, the middle fingertip portion being permanently attached to the middle finger base portion, and the ring finger and the pinky finger segments are fabricated entirely from the relatively thick, warm, protective fabric and are continuous with the body.

4. The glove according to claim 1, wherein the middle finger segment includes a relatively loose fitting middle finger base portion of the relatively thick, warm, protective fabric, the middle finger base portion being continuous with the body, and a relatively tight, form-fitting middle fingertip portion of a relatively thin, tactile material, the middle fingertip portion being permanently attached to the middle finger base portion, the ring finger segment includes a relatively loose fitting ring finger base portion of the relatively thick, warm, protective fabric, the ring finger base portion being continuous with the body, and a relatively tight, form-fitting ring fingertip portion of a relatively thin, tactile material, the ring fingertip portion being permanently attached to the ring finger base portion, and the pinky finger segment is fabricated entirely from the relatively thick, warm, protective fabric continuous with the body.

5. A glove finger comprising:

a relatively loose fitting base portion of a relatively thick, warm, protective material, and a relatively tight, form-fitting tip portion of a relatively thin, tactile material, the tip portion being permanently attached to the base portion.

6. The glove finger according to claim 5, wherein the tip portion is made of a stretchable fabric having an elastic memory.

7. The glove finger according to claim 5, wherein the tip portion is made of a non-stretchable material.

8. The glove finger according to claim 5, wherein the tip portion is at least one inch long.

9. The glove finger according to claim 8, wherein the tip portion extends beyond a center finger joint.

10. The glove finger according to claim 5, wherein the tip portion is attached to the base portion by stitching.

* * * * *